US009518428B2

(12) United States Patent
Prill et al.

(10) Patent No.: US 9,518,428 B2
(45) **Date of Patent: *Dec. 13, 2016**

(54) MECHANISM FOR PROVIDING CONTROLLABLE ANGULAR ORIENTATION WHILE TRANSMITTING TORSIONAL LOAD

(71) Applicant: Dreco Energy Servics ULC, Edmonton (CA)

(72) Inventors: Jonathan Ryan Prill, Edmonton (CA); Nicholas Ryan Marchand, Edmonton (CA)

(73) Assignee: Dreco Energy Services ULC, Alberta (CA)

( * ) Notice: Subject to any disclaimer, the term of this patent is extended or adjusted under 35 U.S.C. 154(b) by 530 days.

This patent is subject to a terminal disclaimer.

(21) Appl. No.: 13/933,087

(22) Filed: Jul. 1, 2013

(65) Prior Publication Data

US 2013/0284516 A1 Oct. 31, 2013

Related U.S. Application Data

(63) Continuation of application No. 12/993,453, filed as application No. PCT/US2009/045490 on May 28, 2009, now Pat. No. 8,474,527.

(Continued)

(51) Int. Cl.

| | |
|---|---|
| ***E21B 7/06*** | (2006.01) |
| ***E21B 47/024*** | (2006.01) |
| ***E21B 47/09*** | (2012.01) |

(52) U.S. Cl.

CPC ..... *E21B 7/06* (2013.01); *E21B 7/067* (2013.01); *E21B 47/024* (2013.01); *E21B 47/09* (2013.01)

(58) Field of Classification Search

CPC ..... E21B 3/03; E21B 4/006; E21B 4/16; E21B 6/06; E21B 7/067; F16D 41/185; F16D 11/14; F16D 47/04; F16D 25/061; F16D 15/1215

(Continued)

(56) References Cited

U.S. PATENT DOCUMENTS

| | | | | |
|---|---|---|---|---|
| 5,495,901 | A | 3/1996 | Livingstone et al. | |
| 5,787,981 | A * | 8/1998 | Taylor | E21B 4/006 166/237 |
| 6,439,321 | B1 * | 8/2002 | Gillis | E21B 7/068 166/117.5 |

OTHER PUBLICATIONS

CIPO Office Action dated Jun. 11, 2015 for Canadian Patent Application No. 2,725,820 filed May 28, 2009.

* cited by examiner

*Primary Examiner* — Taras P Bemko
(74) *Attorney, Agent, or Firm* — Conley Rose, P.C.

(57) ABSTRACT

A mechanism for adjusting the relative angular orientation between two coaxial components includes a housing, a mandrel disposed in the housing, a lower ratchet member disposed around the mandrel, wherein a lower engagement interface between the lower ratchet member and the mandrel restricts relative rotation between the lower ratchet member and the mandrel, an upper ratchet member disposed around the mandrel, wherein an upper engagement interface between the upper ratchet member and the mandrel restricts relative rotation between the upper ratchet member and the mandrel, and a central sleeve disposed around the mandrel, wherein an outer engagement interface between the central sleeve and the housing restricts relative rotation between the central sleeve and the housing, wherein the central sleeve has an upper position configured to transmit torque between the upper ratchet member and the housing and a lower position configured to transfer torque between the lower ratchet member and housing.

20 Claims, 7 Drawing Sheets

Related U.S. Application Data

(60) Provisional application No. 61/057,110, filed on May 29, 2008.

(58) Field of Classification Search
USPC ..... 175/73, 61
See application file for complete search history.

MECHANISM FOR PROVIDING CONTROLLABLE ANGULAR ORIENTATION WHILE TRANSMITTING TORSIONAL LOAD

This application is a continuation of U.S. application Ser. No. 12/993,453 filed Nov. 18, 2010, and entitled "Mechanism For Providing Controllable Angular Orientation While Transmitting Torsional Load," which is the U.S. National Stage under 35 U.S.C. §371 of International Patent Application No. PCT/US2009/045490 filed May 28, 2009, which claims the benefit of U.S. Provisional Patent Application Ser. No. 61/057,110 filed May 29, 2008, entitled "Mechanism For Providing Controllable Angular Orientation While Transmitting Torsional Load."

STATEMENT REGARDING FEDERALLY SPONSORED RESEARCH OR DEVELOPMENT

Not applicable.

BACKGROUND

The present invention relates in general to mechanisms for providing controllable angular orientation between an outer tubular element and a coaxial inner tubular element while transmitting torsional load between the outer and inner tubular elements. More particularly, the invention is directed to such mechanisms which can be incorporated in a downhole tool coupled within a drill string in a wellbore to provide controllable angular orientation between the sections of the string above and below the tool, while the mechanism is subjected to torsional load.

In drilling a borehole (or wellbore) into the earth, such as for the recovery of hydrocarbons or minerals from a subsurface formation, it is conventional practice to connect a drill bit onto the lower end of a "drill string", then rotate the drill string so that the drill bit progresses downward into the earth to create the desired borehole. A typical drill string is made up from an assembly of drill pipe sections connected end-to-end, plus a "bottomhole assembly" ("BHA") disposed between the bottom of the drill pipe sections and the drill bit. The BHA is typically made up of sub-components such as drill collars, stabilizers, reamers and/or other drilling tools and accessories, selected to suit the particular requirements of the well being drilled.

In conventional vertical borehole drilling operations, the drill string and bit are rotated by means of either a "rotary table" or a "top drive" associated with a drilling rig erected at the ground surface over the borehole (or in offshore drilling operations, on a seabed-supported drilling platform or suitably-adapted floating vessel). During the drilling process, a drilling fluid (commonly referred to as "drilling mud" or simply "mud") is pumped under pressure downward from the surface through the drill string, out the drill bit into the wellbore, and then upward back to the surface through the annulus between the drill string and the wellbore. The drilling fluid carries borehole cuttings to the surface, cools the drill bit, and forms a protective cake on the borehole wall (to stabilize and seal the borehole wall), in addition to other beneficial functions.

As an alternative to rotation by a rotary table or a top drive, a drill bit can also be rotated using a "mud motor" (alternatively referred to as a "downhole motor") incorporated into the drill string immediately above the drill bit. The mud motor is powered by drilling mud pumped under pressure through the mud motor in accordance with well-known technologies. The technique of drilling by rotating the drill bit with a mud motor without rotating the drill string is commonly referred to as "slide" drilling, because the non-rotating drill string slides downward within the wellbore as the rotating drill bit cuts deeper into the formation. Torque loads from the mud motor are reacted by opposite torsional loadings transferred to the drill string.

Directional drilling operations using a mud motor require means for controlling the orientation of the mud motor relative to earth while the motor is down hole, in order to control the resulting direction of the curved or deflected wellbore. When drilling with a conventional string of drill pipe, mud motor orientation control can be accomplished by rotating the entire pipe string from surface. However, when drilling with coiled tubing, which cannot easily be rotated from surface, orientation control must be accomplished using means capable of controlling the angular orientation of the mud motor relative to the coiled tubing. It is desirable for this relative orientation to be controllable while drilling operations are in progress, to avoid any unexpected and undesired changes in orientation due to the unwinding and recoiling of the coiled tubing that can occur when drilling is interrupted.

Previous devices typically include an arrangement of lugs and spiral grooves, or an arrangement of lugs and circumferentially-spaced cam bodies, that convert axial motion of a piston into rotational motion of the lower string components. Such devices are generally very complicated in construction and operation, with large numbers of components. The devices also do not allow orientation to be controlled and adjusted while being subjected to torsional loads (such as under normal drilling conditions).

Accordingly, there remains a need for improved and less complicated apparatus for controlling and adjusting the angular orientation between coaxial tubular elements, particularly while under torsional loading. The present invention is directed to this need.

BRIEF SUMMARY OF THE INVENTION

The present invention provides a mechanism which can be incorporated into a tool located between the end of a tubing string and a mud motor, whereby the angular orientation of the mud motor relative to the tubing string can be adjusted without interrupting well-drilling operations, while maintaining effective transfer of torsional loads from the mud motor to the tubing string. In preferred embodiments, the mechanism includes a generally cylindrical mandrel having a central bore throughout its length (for passage of drilling fluid), a cylindrical central section, an upper section above the cylindrical central section, and a lower section below the cylindrical central section. The mandrel is positioned coaxially within a cylindrical tool housing such that the mandrel is rotatable relative to the housing but its axial position relative to the housing is substantially fixed. In a typical well-drilling application of the mechanism, a mud motor will be coupled to the lower end of the mandrel (either directly or through intermediary components).

A cylindrical central sleeve is disposed around the central cylindrical section of the mandrel, with the central sleeve having an internal diameter to provide a close but readily slidable fit with the central cylindrical section of the mandrel. The central sleeve is longitudinally slidable but substantially non-rotatable relative to the housing. In the preferred embodiment, this functionality is facilitated by forming the central sleeve with a plurality of longitudinally-oriented external splines slidingly received within complementary grooves formed in the inner surface of the housing.

The upper and lower ends of the central sleeve each have a plurality of circumferentially-arrayed and equally-spaced ratchet teeth. In the preferred embodiment, each ratchet tooth has a first face that is parallel to the longitudinal axis of the mandrel, plus a second face that is angled relative to the first face (hereinafter these first and second faces will be referred to as "vertical faces" and "sloped faces" respectively).

The mechanism also includes generally cylindrical upper and lower ratchet members disposed, respectively, about the upper and lower sections of the mandrel; i.e., on either side of the central sleeve. The upper and lower ratchet members are mounted such that their axial positions relative to the mandrel are substantially fixed, but also such that they are independently rotatable relative to the mandrel within a limited angular range. In the preferred embodiment of the mechanism, this limited rotational functionality is facilitated by providing the inner cylindrical surfaces of the upper and lower ratchet members with longitudinal grooves configured to receive complementary external splines formed on the upper and lower sections of the mandrel, but with the ratchet member grooves being wider than the corresponding mandrel splines. In preferred embodiments, biasing means (such as bow springs) will be provided to bias the mandrel splines against one side face of the corresponding ratchet member grooves to facilitate torque transfer during drilling.

The lower end of the upper ratchet member has a plurality of circumferentially-arrayed and equally-spaced ratchet teeth configured for mating engagement with the ratchet teeth on the upper end of the central sleeve. Similarly, the upper end of the lower ratchet member has a plurality of circumferentially-arrayed and equally-spaced ratchet teeth configured for mating engagement with the ratchet teeth on the lower end of the central sleeve. The four pluralities of ratchet teeth have matching numbers of ratchet teeth, and, therefore, the same spacing (or angular interval) between adjacent ratchet teeth.

The upper and lower ratchet members are axially spaced such that the central sleeve can slide along the mandrel between:

- an upper position in which the central sleeve's upper ratchet teeth are matingly engaged with the ratchet teeth of the upper ratchet member, with the central sleeve's lower ratchet teeth being clear of the ratchet teeth of the lower ratchet member; and
- a lower position in which the central sleeve's lower ratchet teeth are matingly engaged with the ratchet teeth of the lower ratchet member, with the central sleeve's upper ratchet teeth being clear of the ratchet teeth of the upper ratchet member.

When the central sleeve is in its upper position, its lower ratchet teeth will be offset relative to the ratchet teeth of the lower ratchet member, with the offset preferably being approximately one-half of the typical ratchet tooth spacing (or angular interval). In this configuration, torque from a mud motor connected to the bottom of the mandrel will be transferred from the mandrel to the upper ratchet member via the spline/groove connection therebetween, from the upper ratchet member to the central sleeve via the respective engaged ratchet teeth, and from the central sleeve to the tool housing via the spline/groove connection therebetween.

Similarly, when the central sleeve is in its lower position, its upper ratchet teeth will be offset relative to the ratchet teeth of the upper ratchet member, with the offset preferably being approximately one-half of the typical ratchet tooth spacing (or angular interval). In this configuration, torque from a mud motor connected to the bottom of the mandrel will be transferred from the mandrel to the lower ratchet member via the spline/groove connection therebetween, from the lower ratchet member to the central sleeve via the respective engaged ratchet teeth, and from the central sleeve to the tool housing via the spline/groove connection therebetween.

When the central sleeve is moved from its upper position toward its lower position, the central sleeve's upper ratchet teeth will begin disengaging from the ratchet teeth of the upper ratchet member, but torque transfer between the upper ratchet member and the central sleeve will remain effective until these two sets of ratchet teeth are fully disengaged, because their respective vertical faces will remain in load-transferring contact prior to full disengagement, and until such full disengagement there can be no rotation of the upper ratchet member relative to the sleeve.

However, as the central sleeve is moved from its upper position toward its lower position, the central sleeve's lower ratchet teeth will begin engaging the ratchet teeth of the lower ratchet member before the central sleeve's upper ratchet teeth are fully disengaged from the upper ratchet member. As well, due to the previously-noted offset between the central sleeve's ratchet teeth and the ratchet teeth of the lower ratchet member, the continued downward movement of the central section's ratchet teeth into the ratchet teeth of the lower ratchet member will force the lower ratchet member to rotate approximately one-half of a ratchet tooth interval relative to the mandrel, due to the tips of the central sleeve's lower ratchet teeth bearing downward against the sloped faces of the ratchet teeth of the lower ratchet member. This limited rotational displacement of the lower ratchet member is possible because, as previously noted, the splines in the lower splined section of the mandrel are narrower than the corresponding grooves in the lower ratchet member. During this limited rotational displacement, any springs or other biasing means associated with the lower ratchet member will be compressed or otherwise stressed as the mandrel splines move in an arcuate path within the lower ratchet member grooves.

As the central sleeve reaches its lower position, and as the central sleeve's upper ratchet teeth become fully disengaged from the upper ratchet member, torsional loads acting on the mandrel (e.g. from a mud motor) will cause a sudden angular displacement of the mandrel relative to the central sleeve, while concurrently relieving stresses induced in the biasing means (if present) during the movement of the central sleeve. The amount of this angular displacement will correspond to one-half of the ratchet tooth spacing. Because the central sleeve cannot rotate relative to the tool housing by virtue of the spline/groove connection therebetween, the effect of the angular displacement between the mandrel and the central sleeve is to create the same angular displacement between the tool housing and the mandrel—and therefore between the tool housing and any mud motor or other tool or appurtenance coupled to the mandrel.

In a fashion similar to that described above, upward movement of the central sleeve back to its upper position will induce a similar and additional angular displacement of the mandrel relative to the tool housing.

In alternative embodiments, the mechanism of the present invention may also be configured to internally drive the relative rotation that occurs during orientation in applications that are not subject to external torsional loads.

Although the present invention has particularly beneficial applications in association with directional drilling with coiled tubing, persons skilled in the art will appreciate that it may be also be readily adapted for use in other applications where controlled angular orientation between two or more coaxial components is required, with or without the presence of applied torsional load.

BRIEF DESCRIPTION OF THE DRAWINGS

Embodiments of the invention will now be described with reference to the accompanying figures, in which numerical references denote like parts, and in which.

DETAILED DESCRIPTION

Figure 1:
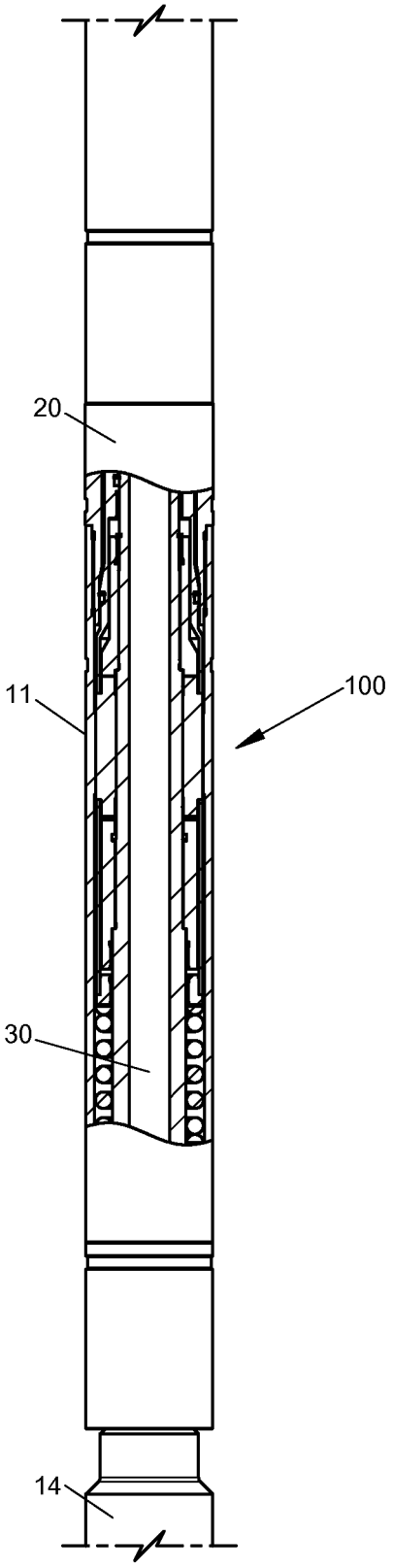
FIG. 1 is a partial-cutaway elevation of a drill string incorporating an angular orientation mechanism in accordance with one embodiment of the present invention.

FIG. 1 illustrates an angular orientation mechanism 100 in accordance with one embodiment of the present invention, incorporated within a string of tubular elements constituting a downhole tool. FIG. 1 depicts one possible orientation of the downhole tool relative to a wellbore, with the tool comprising a cylindrical tool housing 20 (typically made up from a plurality of tool housing members) having an upper end 20U which may be coupled to the lower end of a pipe string or coiled tubing string (not shown), or to other tools or components that are coupled to the lower end of the string. For convenience, the adjectives "upper" and "lower" are used in this patent specification in reference to various components as if mechanism 100 were at all times vertically oriented as in FIG. 1. It will be appreciated, however, that these terms are used in a relative sense only, as the mechanism may be used in a variety of different orientations (such as during directional drilling operations).

Figure 1A:
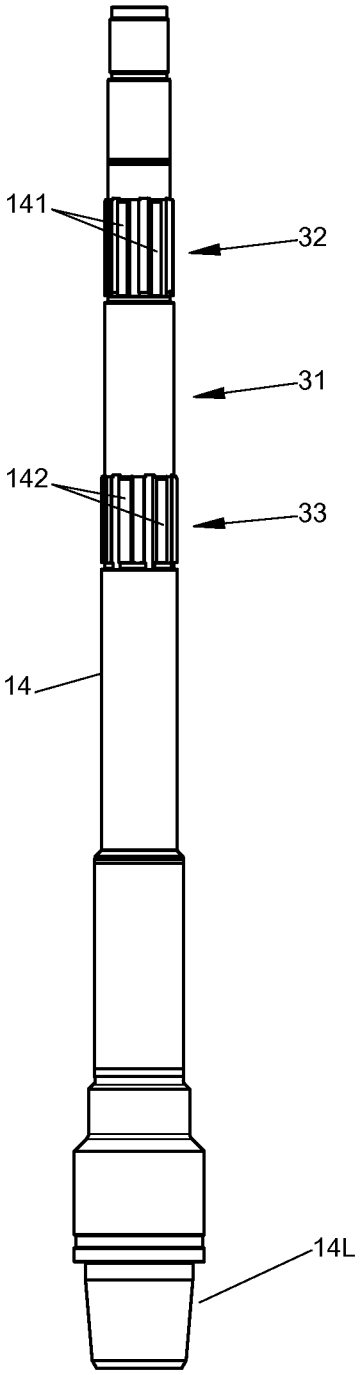
FIG. 1*a* is an elevation of a mandrel suitable for use in accordance with one embodiment of the invention.

Mechanism 100 includes a generally cylindrical mandrel member 14 with a central bore 30 to permit passage of drilling fluid (mud). FIG. 1*a* illustrates one embodiment of a mandrel 14 adapted for use in mechanism 100. Mandrel 14 is axially and radially supported within housing members 20 such that it is coaxially rotatable relative to housing 20 but its axial position relative to housing 20 is substantially fixed. Persons skilled in the art will appreciate that specific means for supporting mandrel 14 within housing 20 as described above may be readily devised, and the present invention is not limited to any particular means of providing such support.

Mandrel 14 includes a central section 31 having a smooth cylindrical outer surface, an upper splined section 32 above central section 31, and a lower splined section 33 below central section 31. As shown in FIG. 1*a*, upper splined section 32 defines a plurality of longitudinally-oriented upper splines 141 spaced around the circumference of upper splined section 32 and projecting outward therefrom. Similarly, lower splined section 33 defines a plurality of longitudinally-oriented lower splines 142 spaced around the circumference of lower splined section 33 and projecting outward therefrom.

The lower end 14L of mandrel 14 may be coupled to a mud motor (not shown) or other tool or other additional lower tubular elements that require controllable angular orientation relative to housing 20 (and relative to a pipe string or tubing string supporting housing 20). Additional or auxiliary elements or appurtenances may be coupled above mandrel 14 (for example, components that provide axial or radial support to mandrel 14, or components involved in controlling the actuation of the mechanism 100). However, such additional elements do not form part of the broadest embodiments of the present invention, and other embodiments of the invention could take alternative forms without departing from the scope of the invention.

Mechanism 100 as illustrated is not limited to orientation relative to a wellbore as described above. In alternative embodiments, mechanism 100 may be inverted such that mandrel 14 is coupled to the lower end of the pipe string or coiled tubing string, or to other tools or components that are coupled to the lower end of the string, with housing 20 being coupled to a drilling tool or other additional lower tubular elements requiring angular orientation control.

In the embodiment illustrated in the FIGS. (and as will be explained in greater detail), torque-transmitting components of mechanism 100 are configured to resist torsional loading applied in the clockwise direction when viewed from above. In alternative embodiments adapted to resist counterclockwise torsional loading, the configurations of torque-transmitting components would be essentially the reverse of the illustrated configurations.

Figure 2:
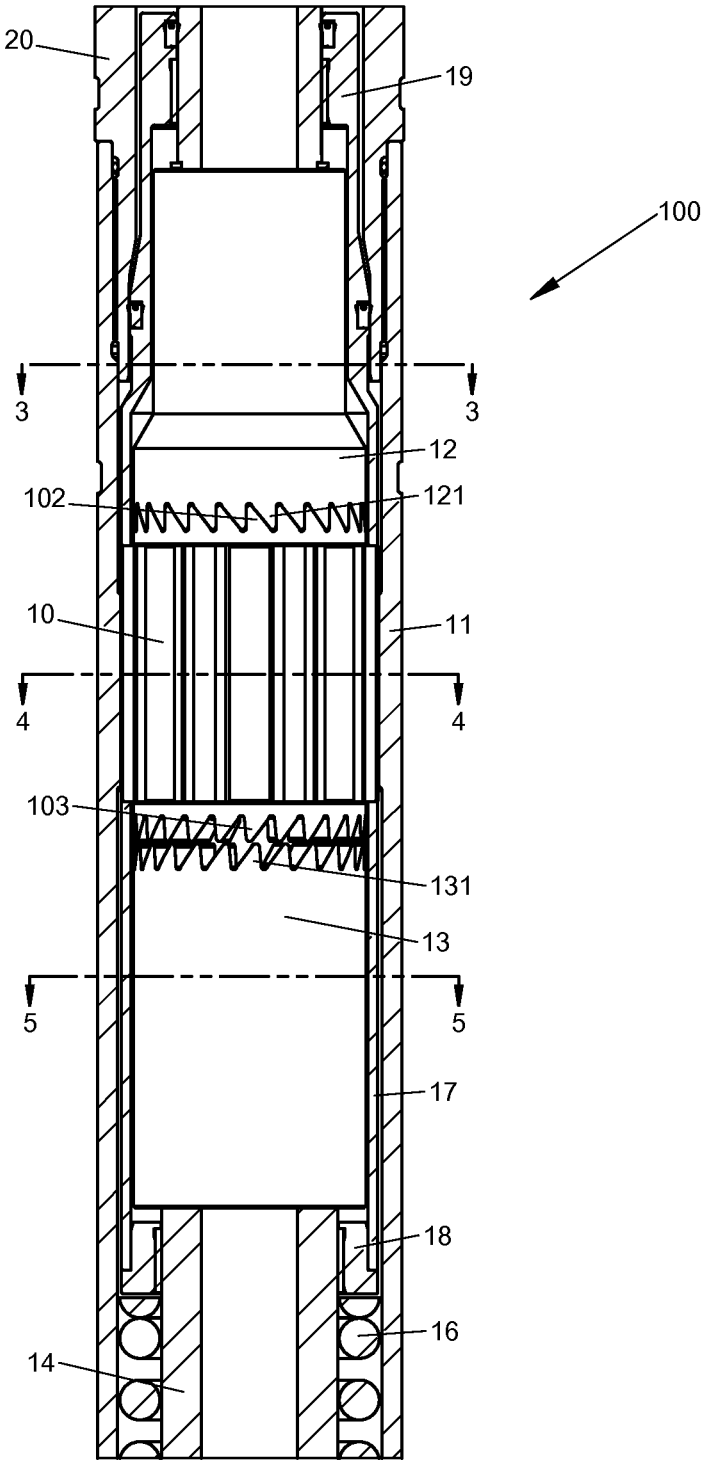
FIG. 2 is a partial cutaway view of the orientation mechanism in FIG. 1, with the central sleeve in its upper position.
Figure 4:
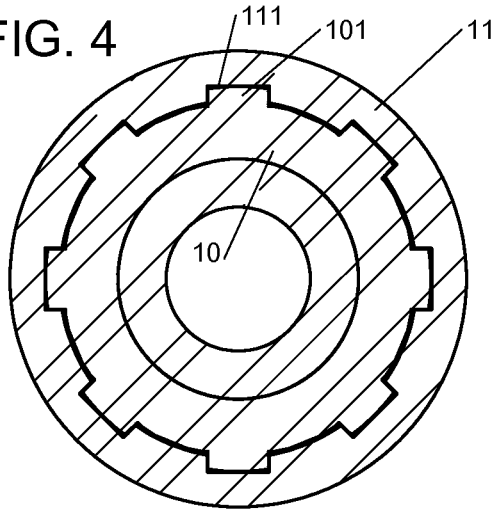
FIG. 4 is a transverse cross-section through the tool housing, central sleeve, and mandrel of the orientation mechanism in FIG. 2.

FIG. 2 is an enlarged detail illustrating the components of mechanism 100 in accordance with the embodiment of FIG. 1. As shown, mechanism 100 includes a generally cylindrical central sleeve 10 with longitudinal external splines 101, plus a generally cylindrical outer housing 11 coupled to the lower end of tool housing 20, and having longitudinal internal grooves 111 configured to receive splines 101 of sleeve 10 in closely-fitting fashion as shown in FIG. 4. The inner diameter of central sleeve 10 is slightly greater than the outer diameter of central section 31 of mandrel 14, such that it may be coaxially disposed around central section 31 as shown in FIG. 4, and will be free to rotate relative to mandrel 14 and free to slide longitudinally relative to mandrel 14. Splines 101 on central sleeve 10 and grooves 111 on housing 11 prevent relative rotation between sleeve 10 and housing 11, while allowing sleeve 10 to travel axially relative to housing 11.

Figure 3:
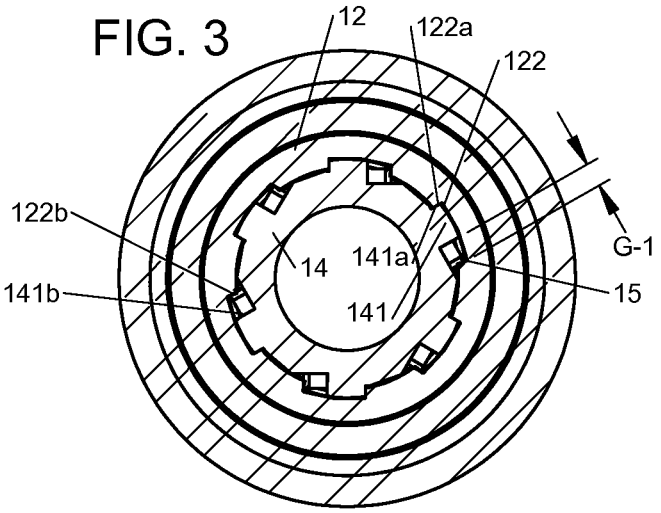
FIG. 3 is a transverse cross-section through the tool housing, cylindrical piston, upper ratchet member, and mandrel of the orientation mechanism in FIG. 2.

A generally cylindrical upper ratchet member 12 with internal grooves 122 is coaxially disposed around upper splined section 32 of mandrel 14, such that splines 141 of mandrel 14 are received within grooves 122. Grooves 122 are wider than splines 141 such that when a first vertical face 141*a* of a given spline 141 is bearing against a first vertical face 122*a* of the corresponding groove 122, a vertical gap G-1 will be formed between the second vertical face 122*b* of groove 122 and the second vertical face 141*b* of spline 141, all as shown in FIG. 3. The axial position of upper ratchet member 12 is substantially fixed relative to mandrel 14, but upper ratchet member 12 is free to rotate coaxially relative to mandrel 14, to the extent allowed by gaps G-1.

Preferred embodiments will include suitable biasing means such that when torque load is not present between upper ratchet member 12 and mandrel 14, first vertical faces 141*a* of splines 141 will be biased toward and against the corresponding first vertical faces 122*a* of grooves 122. As shown in FIG. 3, such biasing means may be in the form of bow springs 15 disposed within the gaps G-1 between second vertical faces 122*b* and 141*b*. However, the present invention is not limited to the use of this or any particular type of biasing means. Persons skilled in the art will appreciate that various functionally effective biasing means may be devised and provided in accordance with known technologies (e.g., torsion springs coupled between the mandrel and upper and lower ratchet members), without departing from the scope of the present invention, and the biasing means may be omitted in alternative embodiments.

Figure 5:
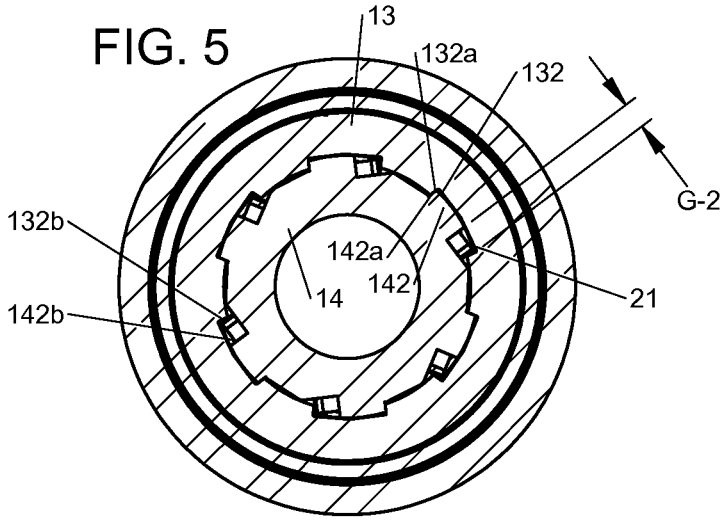
FIG. 5 is a transverse cross-section through the tool housing, lower ratchet member, and mandrel of the orientation mechanism in FIG. 2.

A generally cylindrical lower ratchet member 13 with internal grooves 132 is coaxially disposed around lower splined section 33 of mandrel 14, such that splines 142 of mandrel 14 are received within grooves 132. Grooves 132 are wider than splines 142 such that when a first vertical face 142*a* of a given spline 142 is bearing against a first vertical face 132*a* of the corresponding groove 132, a vertical gap G-2 will be formed between the second vertical face 132*b* of groove 132 and the second vertical face 142*b* of spline 142, all as shown in FIG. 5. The axial position of lower ratchet member 13 is substantially fixed relative to mandrel 14, but lower ratchet member 13 is free to rotate coaxially relative to mandrel 14, to the extent allowed by gaps G-2. Preferred embodiments will include suitable biasing means such that when torque load is not present between lower ratchet member 13 and mandrel 14, first vertical faces 142*a* of splines 142 will be biased toward and against the corresponding first vertical faces 132*a* of grooves 132. As shown in FIG. 5, such biasing means may be in the form of bow springs 21 disposed within the gaps G-2 between second vertical faces 132*b* and 142*b*.

The lower end of upper ratchet member 12 has a circumferentially-arrayed plurality of ratchet teeth 121, each having a vertical face 121*a* and a sloped face 121*b*. The upper end of lower ratchet member 13 has a similar plurality of ratchet teeth 131, each having a vertical face 131*a* and a sloped face 131*b*. The upper end of central sleeve 10 has a plurality of ratchet teeth 102, each having a vertical face 102*a* and a sloped face 102*b*, and configured to mate with ratchet teeth 121 on upper ratchet member 12. Similarly, the lower end of central sleeve 10 has a plurality of ratchet teeth 103, each having a vertical face 103*a* and a sloped face 103*b*, and configured to mate with ratchet teeth 131 on lower ratchet member 13.

Upper ratchet member 12 and lower ratchet member 13 are positioned on mandrel 14 to permit a certain amount of axial movement of central sleeve 10 along mandrel 14, such that when ratchet teeth 102 of central sleeve 10 are matingly engaged with ratchet teeth 121 of upper ratchet member 12, ratchet teeth 103 of central sleeve 10 will be clear of ratchet teeth 131 of lower ratchet member 13. Torque may thus be transmitted between central sleeve 10 and upper ratchet member 12 (i.e., by engagement of ratchet teeth 102 and 121) or between central sleeve 10 and lower ratchet member 13 (i.e., by engagement of ratchet teeth 103 and 131), depending on the axial position of central sleeve 10 during operation of mechanism 100, as will be further explained below.

The incremental angular displacement that occurs during one index cycle is determined by the angular spacing between adjacent ratchet teeth, which is determined by the total number of ratchet teeth of each plurality of ratchet teeth. The tool may be configured with the required number of ratchet teeth per ratchet plurality to achieve a selected incremental angular displacement for each cycle. For example, a ratchet plurality comprising 24 teeth would result in an incremental angular rotation of 15 per index cycle.

The operation and function of mechanism 100 may be clearly understood with reference to the FIGS. and the foregoing description. FIG. 2 illustrates an embodiment of mechanism 100 with central sleeve 10 in its upper position (as previously defined), with ratchet teeth 102 of central sleeve 10 in mating engagement with ratchet teeth 121 of upper ratchet member 12, and with ratchet teeth 103 of central sleeve 10 axially separated from ratchet teeth 131 of lower ratchet member 13. Any torsional load (for example, due to drilling using a mud motor coupled to mandrel 14) is transmitted from mandrel 14 to housing 11 through splines 141 and grooves 122, ratchet teeth 102 and 121, and splines 101 and grooves 111.

When adjustment is required with respect to the angular orientation of mandrel 14 relative to housing 11, an index cycle is initiated by forcing central sleeve 10 downward toward its lower position (previously defined) using suitable central sleeve actuation means capable of providing sufficient force to overcome the friction between sliding or otherwise mechanically-engaged components (e.g., spline/groove arrangements; mating ratchet teeth) during indexing. In the illustrated embodiment, the central sleeve actuation means comprises:

- a generally cylindrical piston 19 which is disposed above central sleeve 10 and is axially movable within an annular space between housing 11 and upper ratchet member 12;
- a cylindrical drive sleeve 17 which is disposed below central sleeve 10 and is axially movable within an annular space between housing 11 and lower ratchet member 13; and
- a helical return spring 16 disposed below and reacting against drive sleeve 17 in association with a drive sleeve retention ring 18.

In this embodiment, piston 19 is actuated by exposure to fluid pressure (either liquid or gaseous) sufficient to force central sleeve 10 downward against drive sleeve 17 so as to compress return spring 16. As return spring 16 is compressed, central sleeve 10 begins to travel axially along central section 31 of mandrel 14, while ratchet teeth 102 of central sleeve 10 begin to move downward relative to ratchet teeth 121 of upper ratchet member 12. During this phase of the indexing operation, however, vertical faces 102*a* of ratchet teeth 102 remain in sliding contact with opposing vertical faces 121*a* of ratchet teeth 121 (as may be seen in FIGS. 6 and 7), and thus remain capable of transmitting torsional load.

Figure 8:
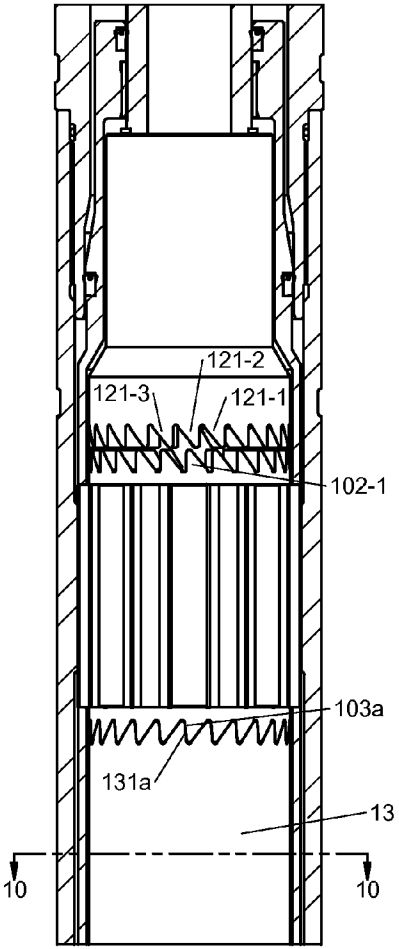
FIG. 8 is a partial cutaway view showing the central sleeve after full downward displacement to its lower position, with its lower ratchet teeth in full mating engagement with the ratchet teeth of the lower ratchet member, and with its upper ratchet teeth fully disengaged from the upper ratchet member.
Figure 7:
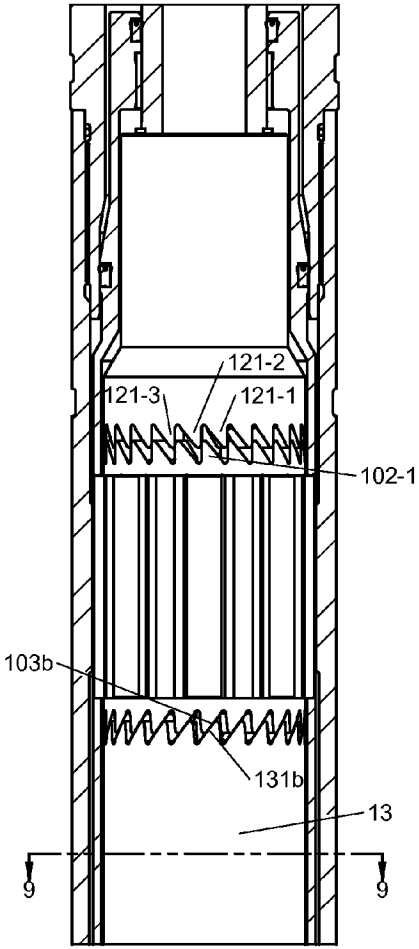
FIG. 7 is similar to FIG. 6 but with the central sleeve displaced further downward, with its lower ratchet teeth engaging the sloped faces of the ratchet teeth of the lower ratchet member so as to incrementally rotate the lower ratchet member in a counterclockwise direction.
Figure 6:
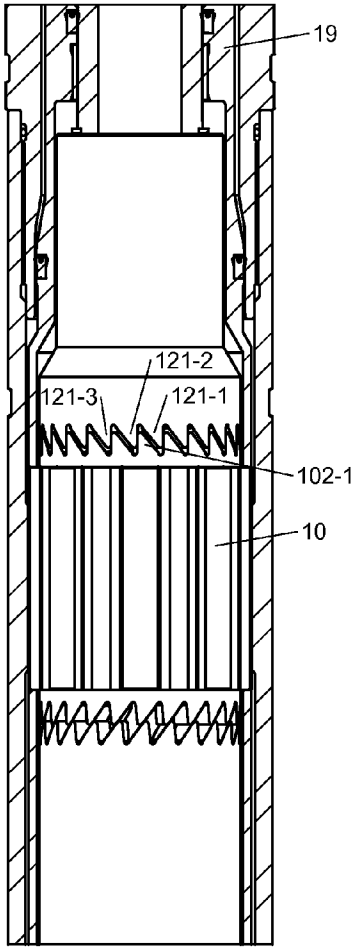
FIG. 6 is a partial cutaway view of the orientation mechanism in FIG. 2, with the central sleeve displaced slightly downward from its upper position, with its lower ratchet teeth beginning to engage the ratchet teeth of the lower ratchet member.
Figure 10:
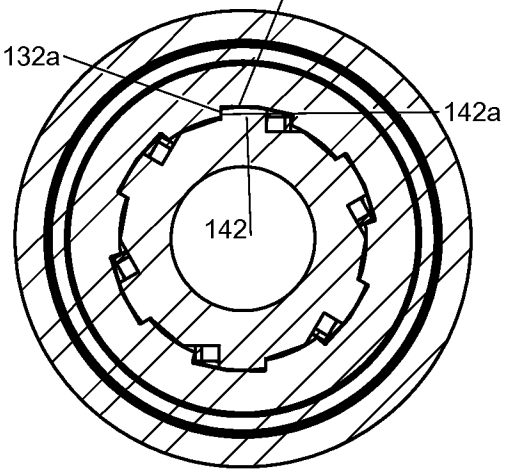
FIG. 10 is a transverse cross-section through the tool housing, lower ratchet member, and mandrel, as viewed after full downward displacement of the central sleeve as in FIG. 8.
Figure 9:
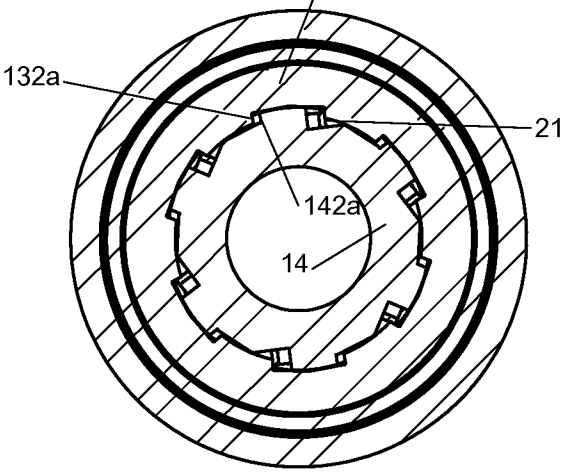
FIG. 9 is a transverse cross-section through the tool housing, lower ratchet member, and mandrel, as viewed during downward displacement of the central sleeve as in FIG. 7.

As illustrated in FIG. 6, representative ratchet tooth 102-1 is initially located between adjacent ratchet teeth 121-1 and 121-2. As central sleeve 10 continues to travel downward, sloped faces 103*b* of ratchet teeth 103 begin to contact sloped faces 131*b* of ratchet teeth 131, as shown in FIG. 7. Due to the angular inclination of sloped faces 103*b* and 131*b*, lower ratchet member 13 is thus forced to rotate relative to mandrel 14 opposite to the direction of torsional load (i.e., counterclockwise in the illustrated embodiment), while bow springs 21 compress and vertical faces 132*a* of grooves 132 separate from vertical faces 142*a* of splines 142, as shown in FIG. 9. Ratchet teeth 102 continue to separate from ratchet teeth 121 until they fully disengage. At this point, there is a sudden relative rotation between mandrel 14 and central sleeve 10 in the direction of torsional load. Concurrently, ratchet teeth 103 become fully engaged with ratchet teeth 131 as central sleeve 10 reaches its lower position, as shown in FIG. 8. Rotation between mandrel 14 and central sleeve 10 continues until vertical faces 142*a* of splines 142 contact vertical faces 132*a* of grooves 132, as shown in FIG. 10. At this point of the index cycle, angular displacement between mandrel 14 and central sleeve 10 is approximately one-half of the total angular displacement of one full index cycle. In this position, ratchet teeth 102 and 121 are separated, and torsional load is transmitted from mandrel 14 to housing 11 through splines 142 and grooves 132, ratchet teeth 103 and 131, and splines 101 and grooves 111.

Figure 13:
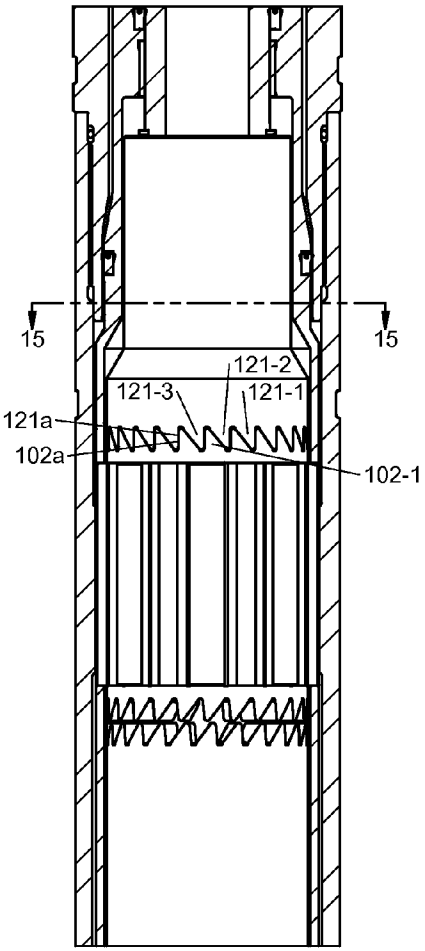
FIG. 13 is a partial cutaway view showing the central sleeve after full upward displacement back to its upper position, with its upper ratchet teeth in full mating engagement with the ratchet teeth of the upper ratchet member, and with its lower ratchet teeth fully disengaged from the lower ratchet member.
Figure 12:
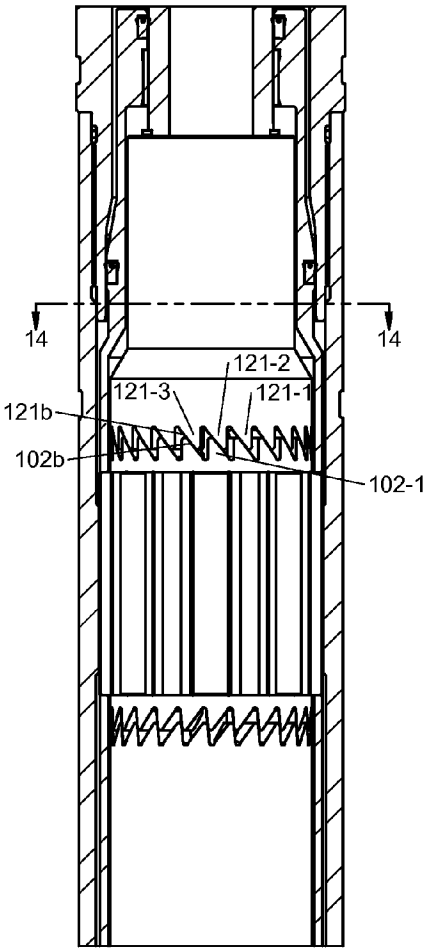
FIG. 12 is similar to FIG. 11 but with the central sleeve displaced further upward, with its upper ratchet teeth engaging the sloped faces of the ratchet teeth of the upper ratchet member so as to incrementally rotate the upper ratchet member in a counterclockwise direction.
Figure 11:
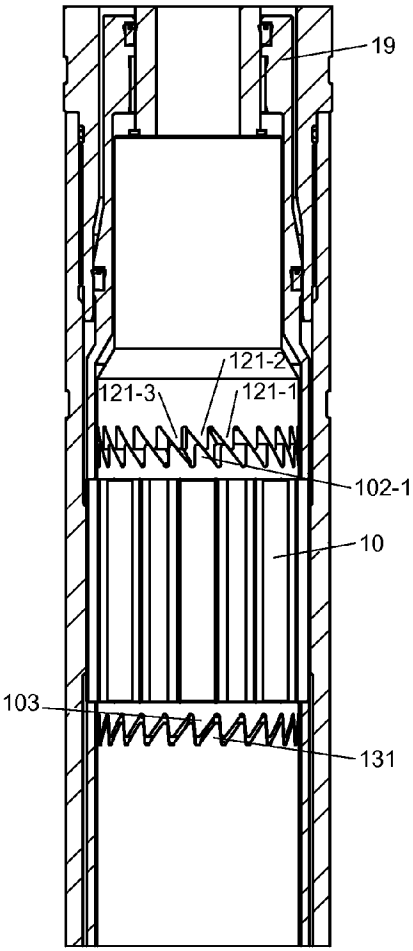
FIG. 11 is a partial cutaway view of the orientation mechanism in FIG. 2, with the central sleeve displaced slightly upward from its lower position, and with its upper ratchet teeth beginning to engage the ratchet teeth of the upper ratchet member.
Figure 15:
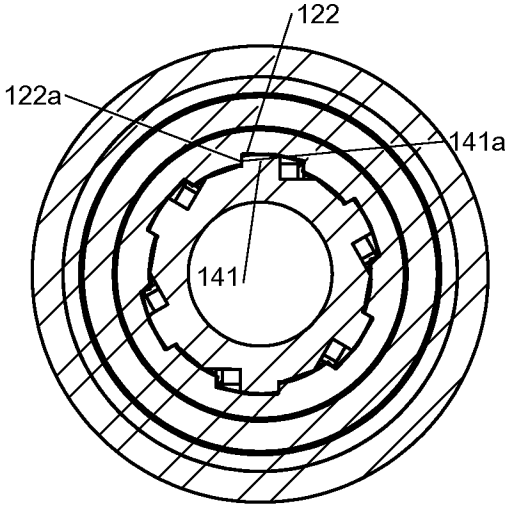
FIG. 15 is a transverse cross-section through the tool housing, cylindrical piston, upper ratchet member, and mandrel, as viewed after full upward displacement of the central sleeve as in FIG. 13.
Figure 14:
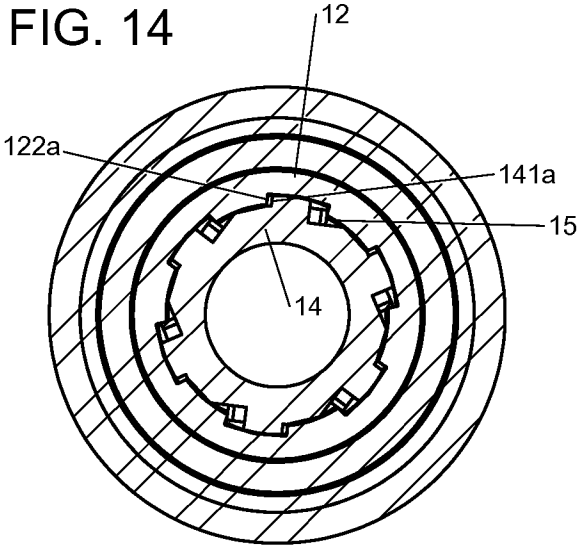
FIG. 14 is a transverse cross-section through the tool housing, cylindrical piston, upper ratchet member, and mandrel, as viewed during upward displacement of the central sleeve as in FIG. 12.

To complete the index cycle, fluid pressure acting on piston 19 is sufficiently decreased such that return spring 16 forces central sleeve 10 to travel axially along mandrel 14 to return to its upper position. Ratchet teeth 103 begin to separate from ratchet teeth 131 while remaining torsionally engaged and capable of transmitting torsional load, with vertical faces 103*a* of ratchet teeth 103 remaining in sliding contact with opposing vertical faces 131*a* of ratchet teeth 131 as seen in FIGS. 11 and 12. Because of the angular displacement between central sleeve 10 and mandrel 14, as ratchet teeth 102 and 121 begin to reengage, ratchet tooth 102-1 is now located between ratchet teeth 121-2 and 121-3. Contact between sloped faces 102*b* of ratchet teeth 102 and sloped faces 121*b* of ratchet teeth 121, as shown in FIG. 12, causes upper ratchet member 12 to rotate relative to mandrel 14 opposite to the direction of torsional load, while bow springs 15 compress and vertical faces 122*a* of grooves 122 separate from vertical faces 141*a* of splines 141, as shown in FIG. 14. Travel of central sleeve 10 continues until ratchet teeth 103 disengage from ratchet teeth 131, and torsional load causes mandrel 14 to rotate relative to central sleeve 10. Vertical faces 102*a* of ratchet teeth 102 engage with vertical faces 121*a* of ratchet teeth 121, and vertical faces 141*a* of splines 141 contact faces 122*a* of grooves 122, as shown in FIGS. 13 and 15. Mechanism 100 has now returned to the initial position shown in FIG. 2, but with ratchet teeth 102 and 121 having indexed one incremental amount, determined by the angular distance between adjacent teeth, and with mandrel 14 having rotated by this same amount relative to housing 11. The index cycle is repeated until the desired orientation between elements above and below the tool is achieved.

Persons skilled in the art will appreciate that any of various means or mechanisms could be used to actuate piston 19, and the present invention is not limited or restricted to the use of any particular means of actuating piston 19. In alternative embodiments, piston 19 could be actuated by functionally effective means other than fluid pressure, without departing from the scope of the present invention. Furthermore, the invention is not limited or restricted to use of the central sleeve actuation means described and illustrated herein, or any other particular central sleeve actuation means. Persons skilled in the art will recognize that other functionally effective central sleeve actuation means can be readily devised and provided in accordance with known technologies, without departing from the scope of the invention.

In accordance with embodiments of the present invention as described above, applied torsional load drives the relative angular rotation that occurs during an index cycle. Mechanism 100 could alternatively be configured such that the relative angular rotation is internally driven. One way to achieve this would be to have strong enough biasing means between upper ratchet member 12 and mandrel 14, and between lower ratchet member 13 and mandrel 14, to induce enough torque to effect the relative rotation of mandrel 14 during the index cycle.

Another method would be to have upper ratchet member 12 and lower ratchet member 13 rotationally fixed to mandrel 14. In that configuration, as central sleeve 10 translates axially on the downstroke or upstroke, contact between sloped faces 103*b* and sloped faces 131*b*, or between sloped faces 102*b* and sloped faces 121*b*, would provide the driving force to rotate mandrel 14 relative to housing 11, so that indexing could be accomplished in the absence of an applied torsional load.

It will be readily appreciated by those skilled in the art that various modifications of the present invention may be devised without departing from the essential concept of the invention, and all such modifications are intended to come within the scope of the present invention. It is to be especially understood that the invention is not intended to be limited to illustrated embodiments, and that the substitution of a variant of a claimed element or feature, without any substantial resultant change in the working of the invention, will not constitute a departure from the scope of the invention. To provide one particular non-limiting example, the central sleeve actuation means could be provided in a variety of alternative forms, such as upper and lower gas-actuated or hydraulically-actuated pistons above and below the central sleeve, without a return spring being required.

In this patent document, the term "ratchet teeth" is not to be interpreted as being limited solely to ratchet teeth of form or configuration specifically as described and illustrated herein, but is also intended to encompass alternative means of torque-transferring engagement between the central sleeve and the upper and lower ratchet members in accordance with the described operative principles of the present invention. Similarly, the term "ratchet member" is to be understood as referring to a member incorporating means for torque-transferring engagement with the central sleeve, and such engagement means may but will not necessarily comprise ratchet teeth as such. Persons skilled in the art will recognize that alternative torque-transfer engagement means may be devised using known technologies without departing from the scope of the invention. To provide only one non-limiting example, the torque-transfer engagement means in an alternative embodiment of the present invention could comprise a series of circumferentially-spaced lugs on either end of the central sleeve, with each lug being operatively engageable with a ratchet-shaped slot along the circumference each of the upper and lower ratchet members.

In this patent document, any form of the word "comprise" is to be understood in its non-limiting sense to mean that any item following such word is included, but items not specifically mentioned are not excluded. A reference to an element by the indefinite article "a" does not exclude the possibility that more than one of the element is present, unless the context clearly requires that there be one and only one such element.

Any use of any form of the terms "connect", "engage", "couple", "attach", or any other term describing an interaction between elements is not meant to limit the interaction to direct interaction between the subject elements, and may also include indirect interaction between the elements such as through secondary or intermediary structure. Relational terms (such as but not limited to) "parallel", "perpendicular", "coaxial", "coincident", "intersecting", and "equidistant" are not intended to denote or require absolute mathematical or geometrical precision. Accordingly, such terms are to be understood as denoting or requiring substantial precision (e.g., "substantially parallel") unless the context clearly requires otherwise.

What is claimed is:

1. A mechanism for adjusting the relative angular orientation between two coaxial components, said mechanism comprising:

a housing;

a mandrel disposed in the housing;

a lower ratchet member disposed around the mandrel, wherein a lower engagement interface between the lower ratchet member and the mandrel restricts relative rotation between the lower ratchet member and the mandrel;

an upper ratchet member disposed around the mandrel, wherein an upper engagement interface between the upper ratchet member and the mandrel restricts relative rotation between the upper ratchet member and the mandrel; and a central sleeve disposed around the mandrel and moveable relative to the mandrel, wherein an outer engagement interface between the central sleeve and the housing restricts relative rotation between the central sleeve and the housing;

wherein the central sleeve has an upper position configured to transmit torque between the upper ratchet member and the housing and a lower position configured to transfer torque between the lower ratchet member and housing; wherein the central sleeve comprises a plurality of external longitudinal splines configured to engage a plurality of internal longitudinal grooves of the housing at the outer engagement interface.

2. The angular orientation mechanism of claim 1, further comprising a central sleeve actuation member configured to actuate the central sleeve between the upper and lower positions.

3. The angular orientation mechanism of claim 2, wherein the central sleeve actuation member comprises:

a piston disposed axially above the central sleeve and configured to engage the central sleeve in response to actuation via fluid pressure; and a drive sleeve disposed below the central sleeve and configured to compress a return spring in response to engagement from the central sleeve.

4. The angular orientation mechanism of claim 1, wherein:

the mandrel comprises a plurality of lower external splines and a plurality of upper external splines axially spaced from the plurality of lower external splines;

the lower ratchet member comprises a plurality of internal grooves configured to receive the lower external splines of the mandrel at the lower engagement interface; and the upper ratchet member comprises a plurality of internal grooves configured to receive the upper external splines of the mandrel at the upper engagement interface.

5. The angular orientation mechanism of claim 4, wherein a biasing member is disposed in each of the upper ratchet member grooves and the lower ratchet member grooves, and wherein the biasing members are configured to angularly bias the upper and lower ratchet members relative to the mandrel.

6. The angular orientation mechanism of claim 1, wherein:

the lower engagement interface between the lower ratchet member and the mandrel restricts relative rotation between the lower ratchet member and the mandrel within a first limited angular range; and the upper engagement interface between the upper ratchet member and the mandrel restricts relative rotation between the upper ratchet member and the mandrel within a second limited angular range.

7. The angular orientation mechanism of claim 1, wherein:

the lower ratchet member comprises a first plurality of teeth at an upper end of the lower ratchet member;

the upper ratchet member comprises a second plurality of teeth at a lower end of the upper ratchet member;

the central sleeve comprises a third plurality of teeth disposed at an upper end of the sleeve and a fourth plurality of teeth disposed at a lower end of the sleeve;

when the central sleeve is in the upper position, the second plurality of teeth are engaged with the third plurality of teeth, while the first plurality of teeth are separated from the fourth plurality of teeth; and when the central sleeve is in the lower position, the first plurality of teeth are engaged with the fourth plurality of teeth, while the second plurality of teeth are separated from the third plurality of teeth.

8. The angular orientation mechanism of claim 7, wherein:

when the central sleeve is in the upper position, the first plurality of teeth are angularly offset from the fourth plurality of teeth; and when the central sleeve is in the lower position, the second plurality of teeth are angularly offset from the third plurality of teeth.

9. A mechanism for adjusting the relative angular orientation between two coaxial components, said mechanism comprising:

a housing;

a mandrel disposed within the housing;

a lower ratchet member disposed around the mandrel and configured to transfer torque between the lower ratchet member and the mandrel;

an upper ratchet member disposed around the mandrel and configured to transfer torque between the upper ratchet member and the mandrel; and a central sleeve disposed around the mandrel and configured to transfer torque between the central sleeve and the housing via an engagement interface disposed radially between the central sleeve and the housing;

wherein the central sleeve is movable between an upper position in which the central sleeve is engaged with the upper ratchet member and a lower position in which the central sleeve is engaged with the lower ratchet member; wherein the central sleeve comprises a plurality of external longitudinal splines configured to engage a plurality of internal longitudinal grooves of the housing thereby transferring torque between the central sleeve and the housing at the engagement interface.

10. The angular orientation mechanism of claim 9, wherein:

the lower ratchet member comprises a first plurality of teeth at an upper end of the lower ratchet member;

the upper ratchet member comprises a second plurality of teeth at a lower end of the upper ratchet member;

the central sleeve comprises a third plurality of teeth disposed at an upper end of the sleeve and a fourth plurality of teeth disposed at a lower end of the sleeve;

when the central sleeve is in the upper position, the second plurality of teeth are engaged with the third plurality of teeth to transfer torque between the central sleeve and the housing via the upper ratchet member; and when the central sleeve is in the lower position, the first plurality of teeth are engaged with the fourth plurality of teeth to transfer torque between the central sleeve and the housing via the lower ratchet member.

11. The angular orientation mechanism of claim 10, wherein:

when the central sleeve is in the upper position, the first plurality of teeth are angularly offset from the fourth plurality of teeth; and when the central sleeve is in the lower position, the second plurality of teeth are angularly offset from the third plurality of teeth.

12. The angular orientation mechanism of claim 9, wherein:

the housing comprises a plurality of internal grooves;

the mandrel comprises a plurality of lower external splines and a plurality of upper external splines axially spaced from the plurality of lower external splines;

the lower ratchet member comprises a plurality of internal grooves configured to receive the lower external splines of the mandrel to restrict relative rotation between the lower ratchet member and the mandrel within a first limited angular range thereby transferring torque between the lower ratchet member and the mandrel; and the upper ratchet member comprises a plurality of internal grooves configured to receive the upper external splines of the mandrel to restrict relative rotation between the upper ratchet member and the mandrel within a second limited angular range thereby transferring torque between the upper ratchet member and the mandrel.

13. The angular orientation mechanism of claim 12, further comprising a plurality of biasing members disposed within the grooves of the upper and lower ratchet members, wherein the biasing members are configured to bias the upper and lower external splines of the mandrel toward torque-transferring contact with vertical faces of the corresponding grooves in the upper and lower ratchet members.

14. The angular orientation mechanism of claim 13, wherein the biasing members comprise bow springs disposed in the grooves of the upper and lower ratchet members.

15. A method of adjusting the relative angular orientation between two coaxial components, comprising:

moving a central sleeve axially in a first direction relative to a mandrel;

engaging the central sleeve with a lower ratchet member;

after engaging the central sleeve with the lower ratchet member:

transferring torque between the mandrel and the lower ratchet member via a lower engagement interface therebetween;

transferring torque between the lower ratchet member and the central sleeve; and transferring torque between the central sleeve and an outer housing by engaging external longitudinal splines of the central sleeve with internal longitudinal grooves of the outer housing at an outer engagement interface.

16. The method of claim 15, further comprising:

moving the central sleeve axially in a second direction relative to the mandrel;

disengaging the central sleeve from the lower ratchet member;

engaging the central sleeve with an upper ratchet member;

after engaging the central sleeve with the upper ratchet member:

transferring torque between the mandrel and the upper ratchet member via an upper engagement interface therebetween; and transferring torque between the upper ratchet member and the central sleeve.

17. The method of claim 16, further comprising rotating the mandrel within a limited angular range relative to the upper ratchet member.

18. The method of claim 15, wherein:

transferring torque between the mandrel and the lower ratchet member comprises engaging external splines of the mandrel with internal grooves of the lower ratchet member at the lower engagement interface;

transferring torque between the lower ratchet member and the central sleeve comprises engaging teeth of the lower ratchet member with lower teeth of the central sleeve.

19. The method of claim 15, further comprising rotating the mandrel within a limited angular range relative to the lower ratchet member.

20. The method of claim 15, wherein moving the central sleeve axially in a first direction relative to the mandrel comprises actuating a piston to engage the central sleeve.

* * * * *